US007004289B2

(12) United States Patent
Shrum, III et al.

(10) Patent No.: US 7,004,289 B2
(45) Date of Patent: Feb. 28, 2006

(54) ELEVATOR PERFORMANCE MEASURING DEVICE AND METHOD

(76) Inventors: William M. Shrum, III, 1728 Orbit Way, Minden, NV (US) 89423; Bill L. Harmon, Jr., 1728 Orbit Way, Minden, NV (US) 89423

( * ) Notice: Subject to any disclaimer, the term of this patent is extended or adjusted under 35 U.S.C. 154(b) by 321 days.

(21) Appl. No.: 10/673,407

(22) Filed: Sep. 30, 2003

(65) Prior Publication Data

US 2005/0077117 A1 Apr. 14, 2005

(51) Int. Cl.
*B66B 1/34* (2006.01)

(52) U.S. Cl. ..... 187/393; 700/83

(58) Field of Classification Search ..... 187/247, 187/248, 391–396, 414; 702/179–185; 340/3.43, 340/3.44; 700/83
See application file for complete search history.

(56) References Cited

U.S. PATENT DOCUMENTS

| | | | | |
|---|---|---|---|---|
| 4,002,973 | A | 1/1977 | Wiesendanger et al. | |
| 4,330,838 | A | 5/1982 | Yoneda et al. | |
| 4,418,795 | A * | 12/1983 | Trosky et al. | 187/391 |
| 4,458,788 | A | 7/1984 | LePore | |
| 4,512,442 | A * | 4/1985 | Moore et al. | 187/393 |
| 4,697,243 | A * | 9/1987 | Moore et al. | 706/59 |
| 4,930,604 | A | 6/1990 | Schienda et al. | |
| 5,027,299 | A | 6/1991 | Uetani | |
| 5,042,621 | A * | 8/1991 | Ovaska et al. | 187/393 |
| 5,257,176 | A * | 10/1993 | Uetani | 700/83 |
| 5,431,252 | A * | 7/1995 | Morrison | 187/394 |
| 5,522,480 | A | 6/1996 | Hofmann | |
| 5,787,020 | A | 7/1998 | Molliere et al. | |
| 5,817,994 | A | 10/1998 | Fried et al. | |
| 6,330,935 | B1 * | 12/2001 | Systermans | 187/391 |
| 2003/0121730 | A1 | 7/2003 | Liu et al. | |
| 2003/0192746 | A1 * | 10/2003 | Suzuki | 187/391 |

FOREIGN PATENT DOCUMENTS

| | | |
|---|---|---|
| EP | 0 367 388 | 8/1989 |
| WO | WO 01/14237 | 3/2001 |

* cited by examiner

*Primary Examiner*—Jonathan Salata
(74) *Attorney, Agent, or Firm*—Richard C. Litman

(57) ABSTRACT

The elevator performance meter is an embedded processor device specifically designed to measure the variations in velocity, acceleration, jerk and run duration as an elevator ascends and descends along a vertical axis. The performance meter utilizes an internal processor that is directly connected to a sensor via an analog to digital conversion unit, a program storage device, a display, a keypad, and power subsystems that are all contained within a single enclosure. The performance meter includes a display screen on its top surface with a keyboard for entering in operator menu selections. The performance meter is placed on the floor of an elevator and the embedded sensor measures certain physical properties of the elevator as it makes a floor-to-floor run. The measurement data is presented on the internal display as an alphanumeric readout that allows an elevator's performance to be easily defined.

18 Claims, 9 Drawing Sheets

ELEVATOR PERFORMANCE MEASURING DEVICE AND METHOD

BACKGROUND OF THE INVENTION

1. Field of the Invention

The present invention relates to elevator performance measuring devices, and more particularly to a self-contained, portable microprocessor system designed to analyze elevator performance in real time and report specific points of information, as they occur in real time, in a easily readable alphanumeric format.

2. Description of the Related Art

Qualitative elevator performance analysis is extremely important to professionals in the elevator industry. Elevator performance analysis is typically done with expensive ride analysis systems. There are two categories of ride analysis systems: portable systems; and fixed systems. Fixed systems are limited to use with a single elevator and always require down time for installation and removal. Portable systems have the advantage of being useful in multiple elevators but are expensive and difficult to operate. Also, most analysis systems, fixed or portable, require a separate computer for analyzing the recorded data.

Because of the cost of the common analysis systems many professionals use alternate methods of analysis that are subjective and inaccurate. The alternate methods use tachometers or stop watches to measure elevator speed. Rate values and jerk values cannot be measured in this manner so these values are commonly left undetermined. Also, many of these methods are unsafe because they require the user to access the elevator pit, hoist way or elevator car top to take the measurements.

The following patent documents disclose systems and devices for measuring the performance of an elevator.

U.S. patent application No. 2003/0121730 published on Jul. 3, 2003 for Liu et al. discloses a condition-base, auto-thresholded elevator maintenance system. The system generates variable thresholds in response to an average defect rate that is generated under certain conditions. Any excess defects set off an internal flag. The internal flag can then generate a maintenance flag that results in a maintenance recommendation for the particular parameter having the defects.

U.S. Pat. No. 4,002,973 issued on Jan. 11, 1977 to Wiesendanger et al. discloses an elevator testing system. The system is removably connected to a control of an elevator system and selectively operated to perform a number of testing sequences. The system provides a number of artificial control signals characteristic of an operating condition for controlling the operation of the elevator system under test conditions. The system is used in a testing sequence with elevator systems employing gated rectifying circuits to accurately monitor gate pushes and other operating functions.

U.S. Pat. No. 4,330,838 issued on May 18, 1982 to Yoneda et al. discloses an elevator test operation apparatus for a multi-floor service elevator. The apparatus comprises a digital computer for processing an elevator control signal. The digital computer stores an elevator operation control program and an interface means for transferring a signal from an elevator control system to the digital computer. The elevator test system further comprises a means for generating test signals and an interface means for transferring those test signals to the digital computer. The system also provides a means for storing various programs for shortening the opening time of the elevator during testing and for establishing the elevator car weight.

U.S. Pat. No. 4,458,788 issued on Jul. 10, 1984 to LePore discloses an analyzer apparatus for evaluating the performance of an elevator transportation system that has a plurality of elevators. The system has a plurality of event accumulator devices and interconnected interface circuits. The interface circuits are each connected to a system component to be monitored and each provides an output signal indicative of the current status of its monitored system component. The accumulator devices accumulate event duration counts as a function of the monitored component current status signals from its interface circuit.

U.S. Pat. No. 4,512,442 issued on Apr. 23, 1985 to Moore et al. discloses methods and apparatus for improving the servicing of an elevator system. The methods are based upon the actual usage of the elevator functions. The usage of predetermined functions is monitored and data is collected. Threshold and limit parameters are provided for the monitored functions and are periodically compared with the usage data. When a threshold value is reached for a particular function a maintenance service is added to a maintenance due list.

U.S. Pat. No. 4,930,604 issued on Jun. 5, 1990 and European Patent Application No. 0 367 388 published on May 9, 1990 to Schienda et al. disclose an elevator diagnostic monitoring apparatus. The apparatus is connected by a serial communication link to at least one computer-based elevator controller in order to monitor the diagnostic output of each connected controller. The diagnostic output of a controller is determined by the normal operating states of the elevator. Any deviations from the normal operating states generate diagnostic messages that are communicated from the controller to the monitoring apparatus.

U.S. Pat. No. 5,027,299 issued on Jun. 25, 1991 to Uetani discloses an apparatus for testing the operation of system components such as elevator cages which has a central processor and stored control programs. The apparatus includes programs that produce diagnostic results and are incorporated with the stored control programs for controlling and operating the system.

U.S. Pat. No. 5,042,621 issued on Aug. 27, 1991 to Ovaska et al. discloses a method and apparatus for the measurement and tuning of an elevator system. The method uses a computer connected to the system. The elevator system is measured and tuned using virtual measuring and tuning components operated by programs of the computer.

U.S. Pat. No. 5,787,020 issued on Jul. 28, 1998 to Molliere et al. discloses a procedure and an apparatus for analyzing elevator functions and detecting deviating functions. An analyzer connected to the elevator learns the normal operation of each elevator independently. Signals occurring during operation are compared with the information thus acquired and a failure alarm is produced or the information is altered to in accordance with the new situation.

International Patent Application No. WO 01/14237 published on Mar. 1, 2001 discloses a device for monitoring an operation of an elevator car. The device includes a measuring unit for measuring the value of predetermined parameters and a processing unit for analyzing the measured parameter values.

U.S. Pat. No. 5,522,480 issued on Jun. 4, 1996 to Hoffman discloses a measurement pick-up to detect physical characteristics of a lift for people or freight. A portable transducer is used to detect physical parameters of an elevator including acceleration and time values. The transducer comprises a sensor, a timer associated with the sensor and a memory unit. The transducer may be connected to an external evaluation unit to download data after the testing is complete.

U.S. Pat. No. 5,817,994 issued on Oct. 6, 1998 to Fried et al. discloses a remote fail-safe control for an elevator. The remote control arrangement includes a wireless transmitter and a wireless receiver that is coupled to an elevator controller. The receiver is detachably connected to wiring that leads to the controller.

The measurement of vertical velocities, accelerations, jerk and run duration is necessary for the installation, maintenance and inspection of passenger and freight elevator systems in order to ensure safe operation of such devices and the safety of those persons which would work or travel on such devices. The measurement of these physical properties can be accomplished utilizing a digital processing device containing a single sensor that is sensitive to accelerations along a vertical axis by placing the device within an elevator car and executing a single floor-to-floor run. This device should be self contained and portable to preclude the necessity of removing the elevator from service, installing any device onto the elevator mechanism, or making alterations to the elevator to perform the measurements. The device should perform the measurements in a manner that eliminates the introduction of human error and opinion. The device should work on any type of elevator and should present the results of the measurements instantly in a format that is recognizable by the common person without the need for specialized training or detailed analysis of a time/amplitude graph.

None of the above inventions and patents, taken either singly or in combination, is seen to describe the instant invention as claimed. Thus an elevator performance meter solving the aforementioned problems is desired.

SUMMARY OF THE INVENTION

The elevator performance meter is an embedded processor device specifically designed to measure the variations in velocity, acceleration, jerk and run duration as an elevator ascends and descends along a vertical axis. The performance meter utilizes an internal processor that is directly connected to a sensor via an analog to digital converter, a program storage device, a display, a keypad, and power subsystems that are all contained within a single enclosure. The performance meter includes a LCD display screen on its top surface with a keypad for entering in operator menu selections. The performance meter is placed on the floor of an elevator and the internal sensor measures certain physical properties of the elevator as it makes a floor-to-floor run.

Vertical elevator movement is dissected into eleven critical categories in real time, as they occur, by an internal embedded digital processor program. The processor program manages all timing, control, display and measurement functions. The format of the measurement data is presented on the display screen as an alphanumeric readout that allows an elevator's performance to be easily defined. The elevator performance data is acquired by monitoring the internal sensor. The output from the sensor is an analog voltage that is proportional to the movement of the elevator along the vertical axis. The analog voltage signal is converted into a digital numerical value via the analog to digital converter. The internal processor mathematically removes the force of gravity from the sensor's output leaving only raw movement data. The raw movement data is filtered through a complex series of digital filtering programs leaving an actual elevator vertical movement data. The embedded processor analyzes the movement data and the results are displayed on the LCD readout.

Accordingly, it is a principal object of the invention to improve the safety and accuracy of elevator performance measurements by designing a self contained elevator performance meter that may instantly perform elevator performance measurements by being placed on the floor of an elevator during a single floor-to-floor run.

It is another object of the invention to provide an elevator performance meter that presents measurement results instantly in an alphanumeric format that is easy to recognize and understand.

It is a further object of the invention to provide an elevator performance meter that eliminates the need for human opinion and reduces the likelihood of human error.

Still another object of the invention is to provide an elevator performance meter that is readily portable to preclude the necessity of removing the elevator from service, installing any device onto the elevator mechanism, or making alterations to the elevator to perform the measurements.

Still another object of the invention is to provide an elevator performance meter that works equally well on all types of elevator systems.

Still another object of the invention is to provide a performance meter that is capable of making measurements and displaying analysis results in standard units or metric units.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
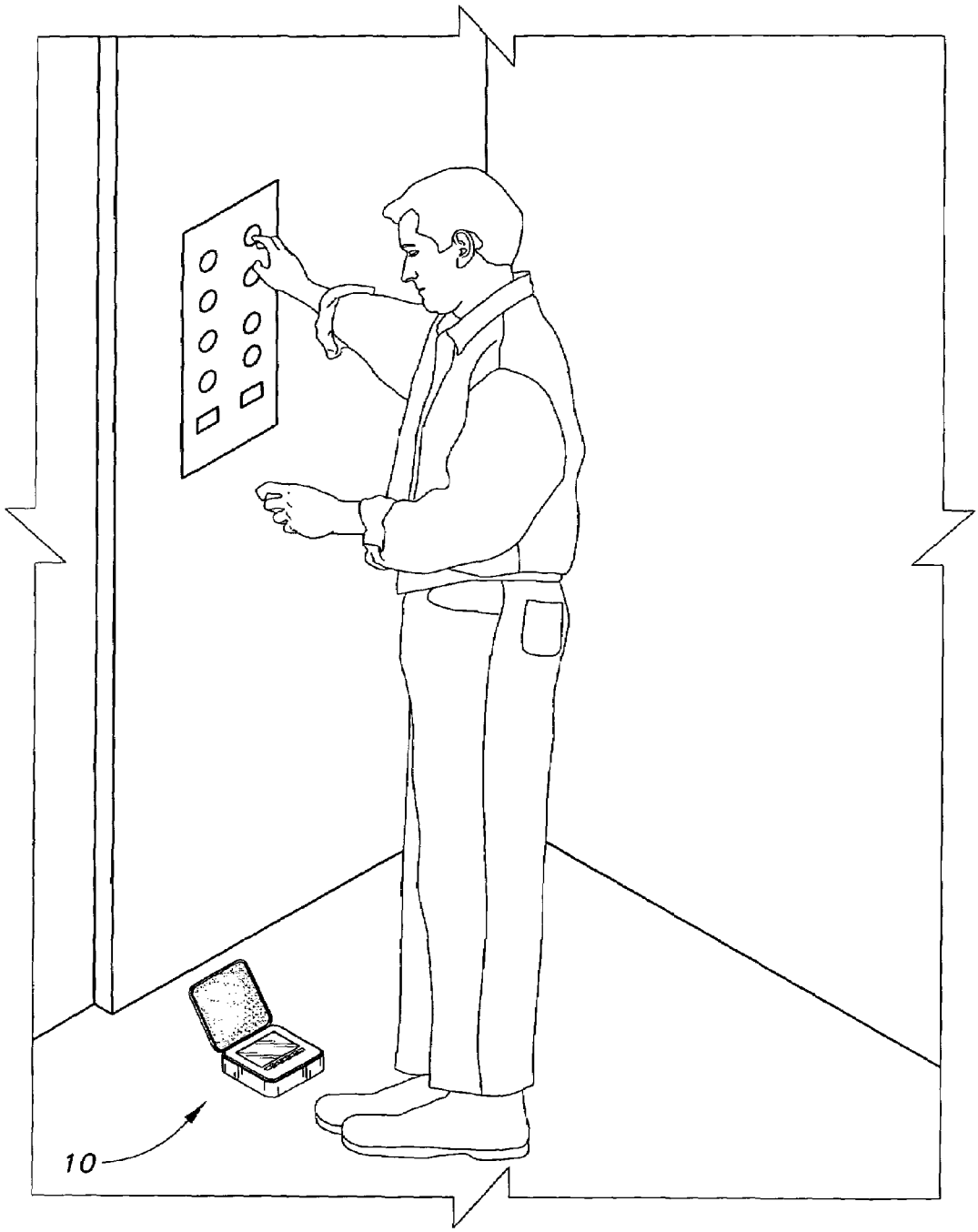
FIG. 1 is an environmental, perspective view of an elevator performance meter according to the present invention.
Figure 2:
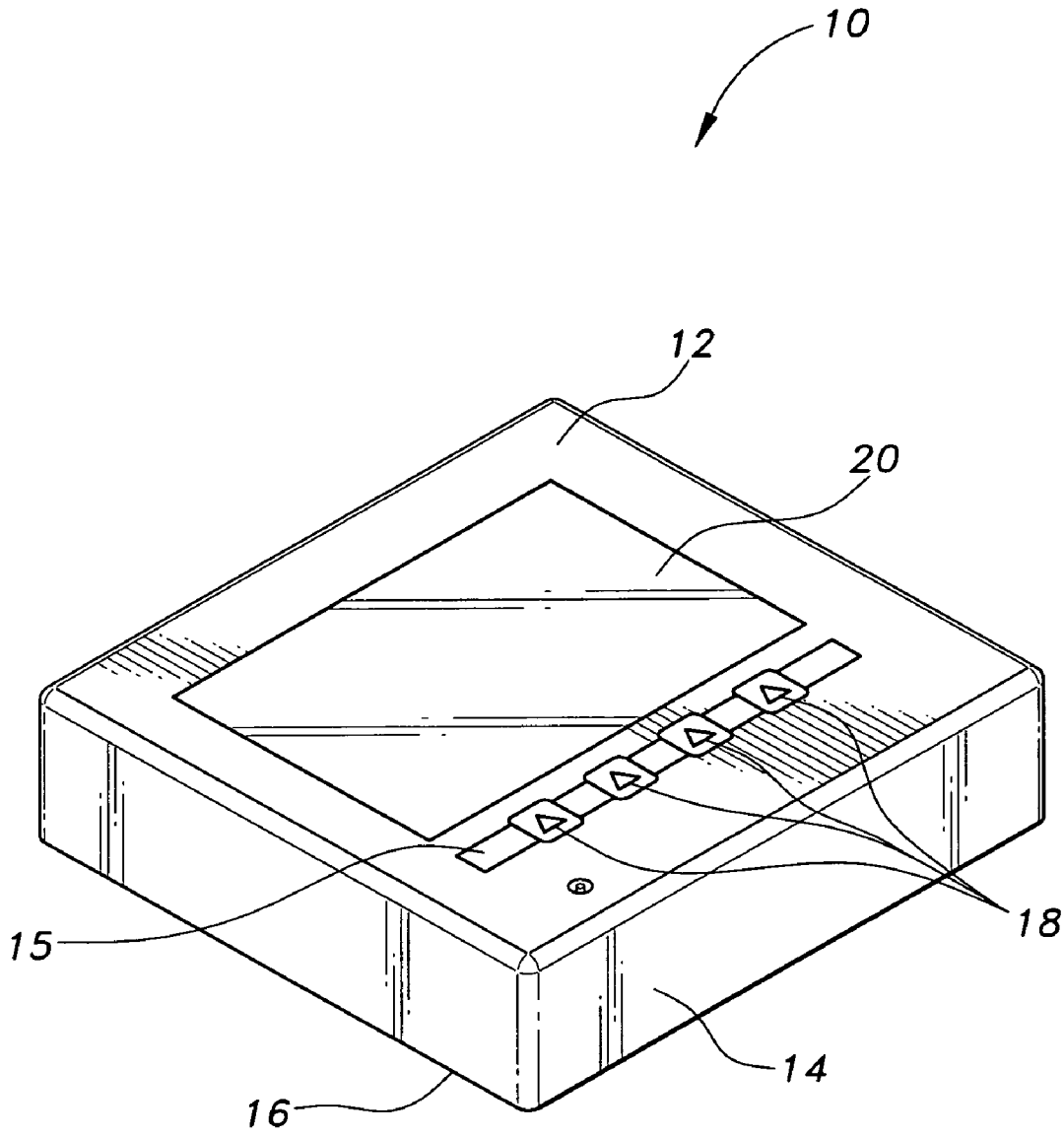
FIG. 2 is a top perspective view of the elevator performance meter.

The present invention is an elevator performance meter that is specifically designed to measure the variations in velocities, accelerations, jerk and run durations of an elevator as it ascends and descends along a vertical axis. The performance meter utilizes an embedded processor that is directly connected to a sensor via an analog to digital conversion unit, a program storage device, a display, a keypad, and power subsystems that are all contained within a single enclosure. FIG. 1 is an environmental, perspective view of the elevator performance meter 10 on the floor of an elevator. FIG. 2 is a top perspective view of the performance meter 10 detailing its exterior features and elements.

The performance meter 10 has an outer housing with a top surface 12, a bottom surface 16 and a plurality of side portions 14. A data entry unit 15 is disposed along the top surface 12 of the performance meter 10 for entering in operator menu selections. The data entry unit 15 is preferably a keypad having a plurality of entry keys 18. A display unit 20 is disposed along the top surface 12 of the performance meter 10 as well. The display unit 20 displays the measurement results as they are analyzed by the performance meter 10 in real time. The display unit 20 is preferably a LCD readout screen, however any appropriate display screen may be used.

Figure 3:
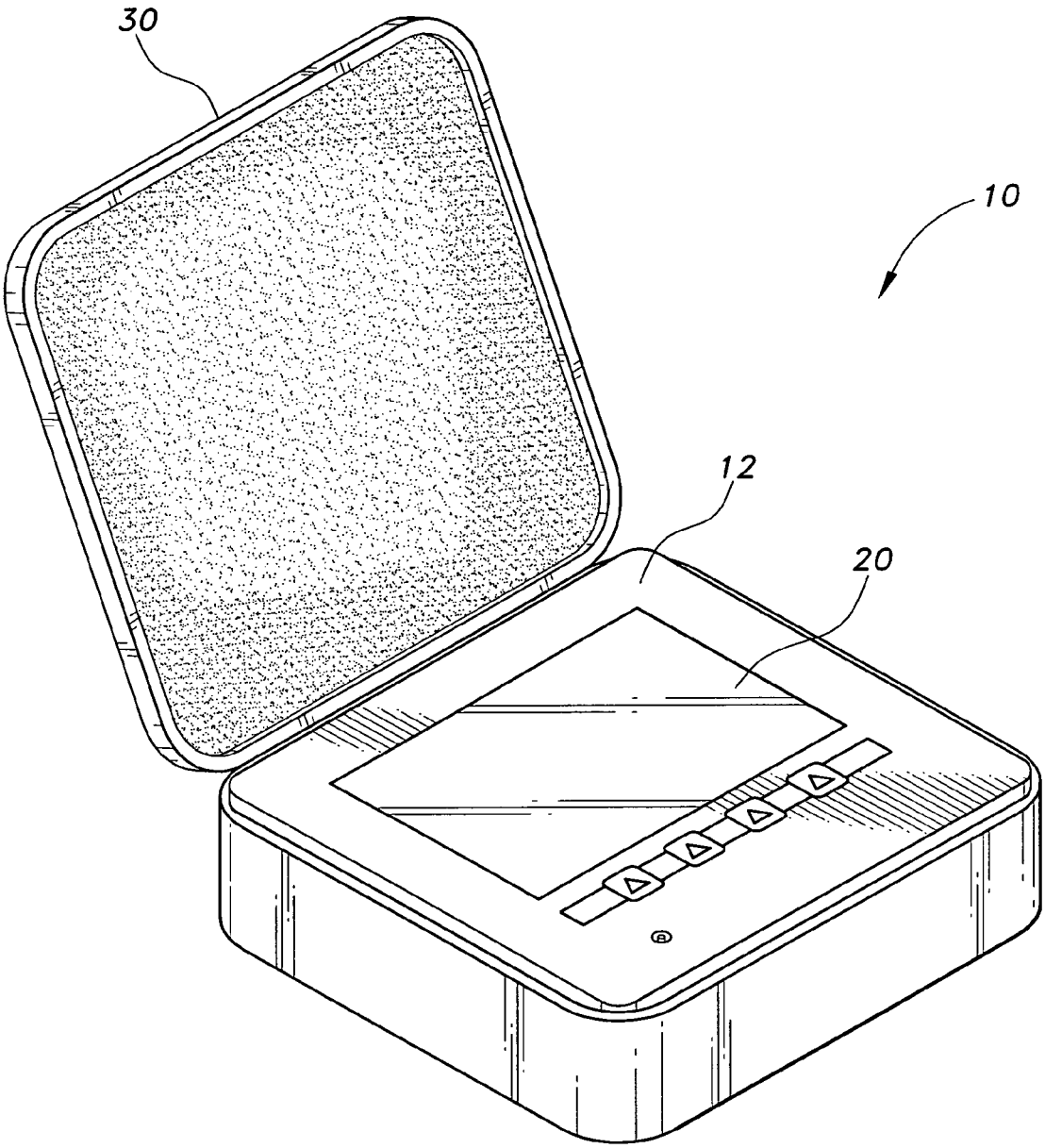
FIG. 3 is a top perspective view of another embodiment of the elevator performance meter.

FIG. 3 is a top perspective view of the elevator performance meter 10 according to another preferred embodiment of the present invention. The performance meter 10 further comprises a protective, padded carrying case 30. The performance meter 10 may be used without being removed from the carrying case 30. It is desirable to conduct the elevator performance measurement tests with the carrying case 30 in place because the carrying case 30 aids in the level placement of the device on the elevator floor by reducing or eliminating uneven surfaces that may have an adverse effect on the accuracy of the elevator performance meter 10.

Figure 4:
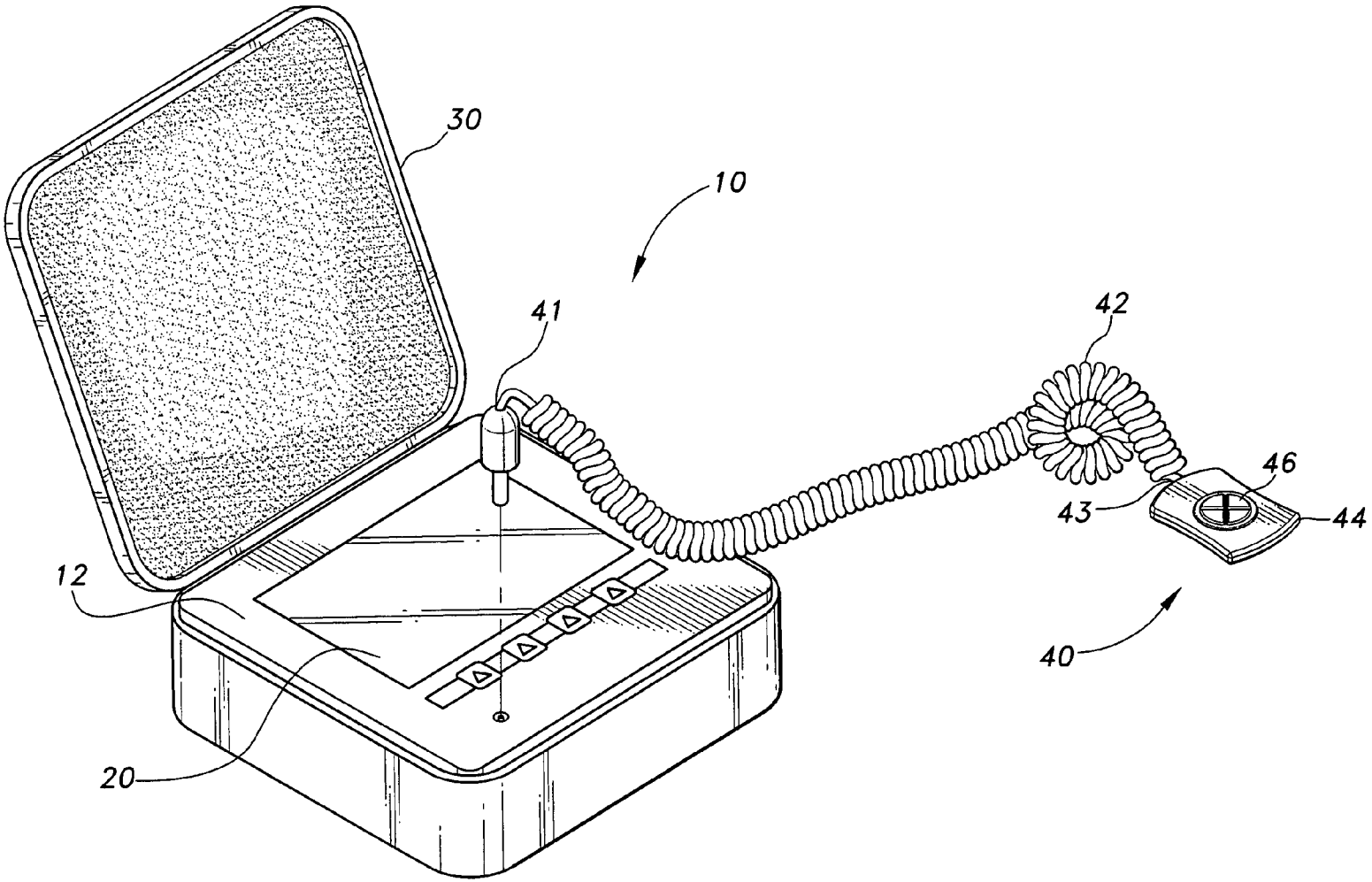
FIG. 4 is a top perspective view of an additional embodiment of the elevator performance meter.

FIG. 4 is a top perspective view of an elevator performance meter 10 according to an additional preferred embodiment of the present invention. The present embodiment of the performance meter 10 further comprises a wire remote keypad device 40. The remote keypad 40 allows the operator to stand while conducting a single or a series of elevator performance measurement tests. The remote keypad 40 comprises an input pad 44 connected to the performance meter 10 by an elongate cord 42. The cord 42 has a first end secured to the pad 44 and a second end secured to the performance meter 10 by a plug portion 41. A plurality of input keys 46 is disposed on the input pad 44 for controlling the functions of the performance meter 10 and entering input data parameters. The input keys 46 represent the same keys 18 that are disposed along the top surface 12 of the performance meter 10.

Figure 6:
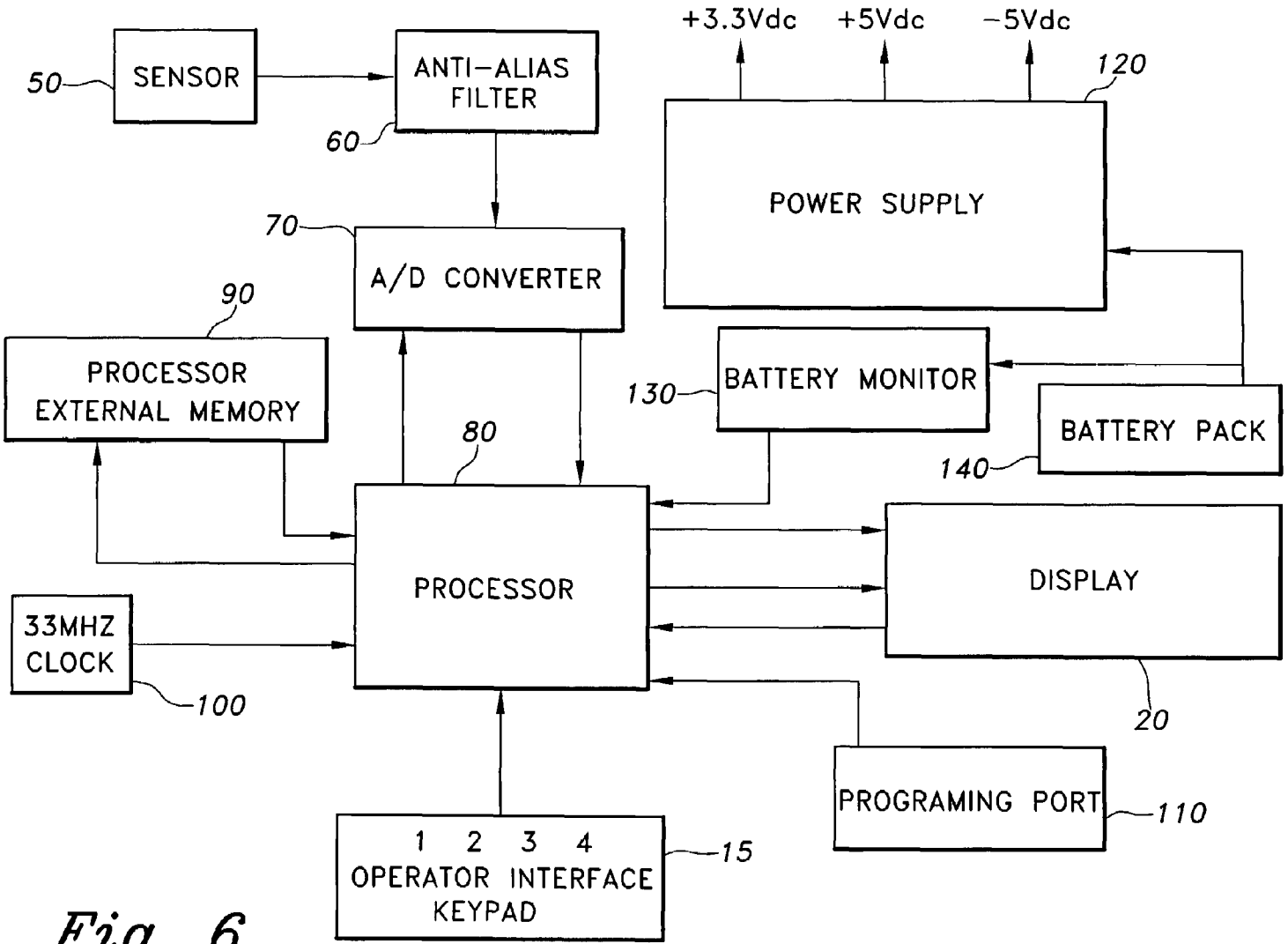
FIG. 6 is a block diagram depicting the flow of data through the interconnected interior elements of the performance meter.

The performance meter 10 is configured as a single self-contained unit having no external sensors. All of the hardware is contained within a single enclosure of the performance meter 10. FIG. 6 is a block diagram depicting the interconnected hardware elements of the performance meter 10. The internal hardware elements of the performance meter 10 comprise a sensor 50, an anti-alias filter 60, an analog/digital converter 70, an embedded processor 80, a processor external memory unit 90, a clock 100, a programming port 110, a power supply 120, a battery monitor 130 and a battery pack 140.

The battery pack 140 preferably comprises four AA alkaline batteries that provide battery power to the power supply 120. The power from the battery pack 140 will allow the performance meter 10 to operate for a minimum of eight continuous hours on one set of batteries. Most ride analysis devices require access to an 110 v outlet on the elevator car or utilize heavy sealed rechargeable batteries. Each of these power supply methods add to the weight and size of the device. The power supply 120 uses the battery power to power the performance meter 10. The power supply 120 uses a pair of electronic switches and inductors to create precisely controlled voltages. Preferably, three voltages, +3.3 Vdc, +5 Vdc and −5 Vdc are produced by the power supply 120. The battery monitor 130 monitors the life of the batteries in the battery pack 140. When the battery pack 140 no longer has enough remaining power to guarantee proper power supply to operate the performance meter 10, the meter 10 halts and a "replace battery" message is displayed on the display screen 20.

The internal sensor 50 continuously monitors the raw vertical acceleration of the elevator. The sensor is preferably a conventional accelerometer. The sensor 50 is in direct communication with an anti-alias filter 60. The anti-alias filter 60 is an electromechanical filter that removes background noise created by alias voltages so that only the true acceleration signal is sent along through the performance meter 10. The anti-alias filter 60 sends low-pass filtered data to an analog/digital (A/D) converter 70. The sensor's analog voltage output is converted into a digital numerical value by the A/D converter 70. The digital data sample is then sent to the internal processor 80, which analyzes the data and sends the results to the display 20.

Additional data is transferred to the processor 80 by the clock 100, the keypad 15, the programming port 110 and the processor external memory 90. The clock 100 provides an accurate time base for the processor's operations. The keypad 15 allows the user to enter operator menu selections into the processor 80. The programming port 110 supplies additional programming data into the processor 80. The external memory 90 supplies boot program data to the processor 80 and receives analysis data from the processor 80 for storage.

The hardware components of the performance meter 10 run on a motherboard—daughterboard configuration. The display unit 20 runs off of a daughterboard that is attached to the main motherboard. All other hardware elements run off of the motherboard.

FIG. 1 depicts the performance meter 10 placed on the floor of the elevator during an elevator performance measurement test. To conduct an elevator performance measuring test the meter 10 is placed on the floor and powered on by turning a power switch to the "on" position. The meter 10 automatically enters into a self-calibration sequence. During the self-calibration sequence the display 20 will flash a "Place on Floor" message. At the end of the calibration sequence the display 20 will flash a "Place Call" message. At this time the operator will place an elevator floor call.

Raw acceleration is continuously monitored by the sensor 50 as the elevator makes the floor-to-floor run. The acceleration raw data is transferred through the anti-alias filter 60 and then converted into a digital signal by the A/D converter 70. The A/D converter 70 samples the raw acceleration data at a fixed rate under the control of the processor program. The converted signal is then sent to the processor 80 where it is measured and analyzed.

Figure 8:
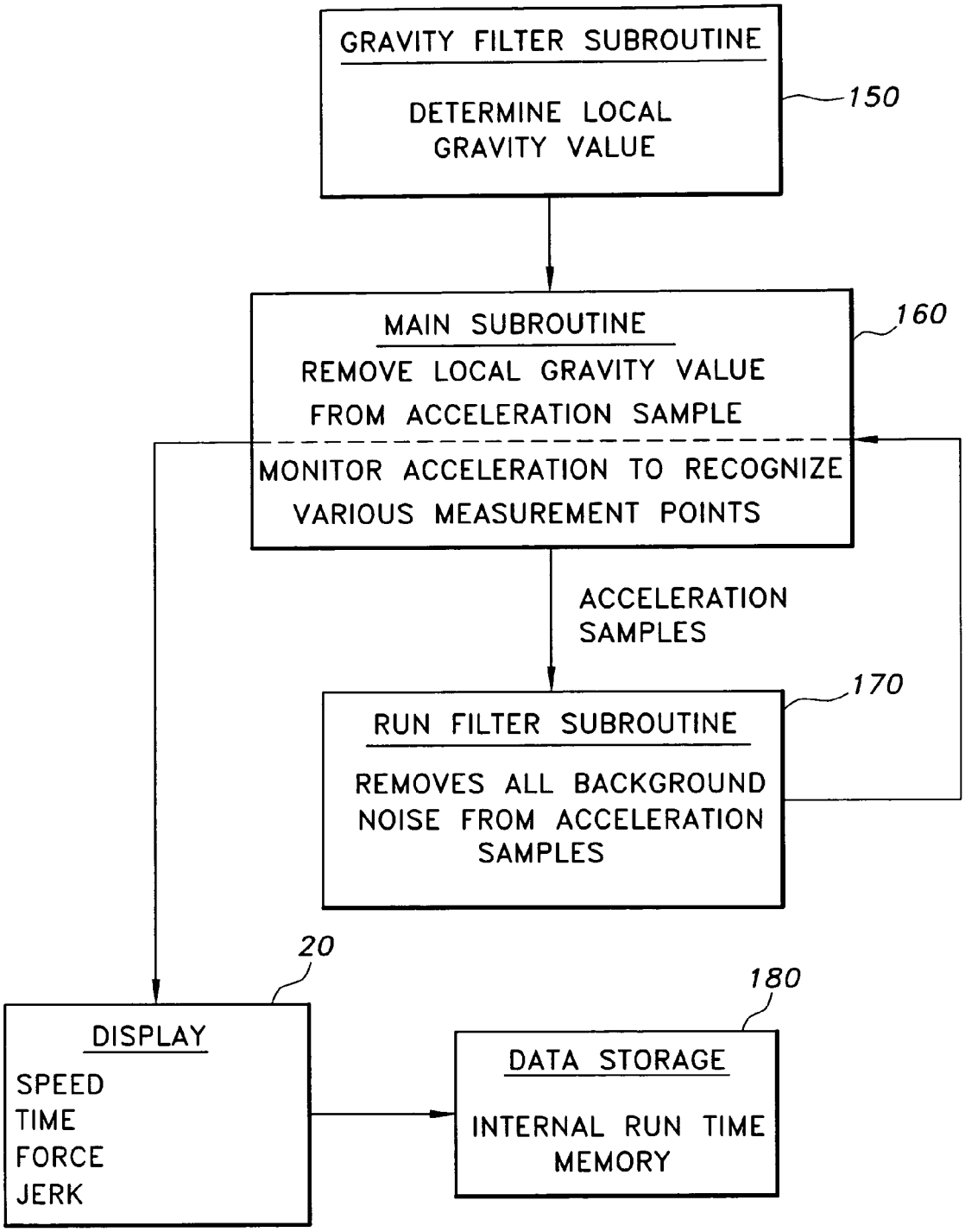
FIG. 8 is a block flow diagram of the processor program of the elevator performance meter.

FIG. 8 is a block flow diagram depicting the general steps carried out by the processor program. The processor program manages the timing, control, display and measurement functions of the elevator performance meter 10. The processor program functions using a number of sub-routines that include filter sub-routines and housekeeping sub-routines. The first step in the measurement test routine is to determine the local gravity value. The local gravity is the force of gravity that the accelerometer is subject to under current conditions. Prior to the performance meter 10 prompting the operator to place a call, a predetermined number of acceleration samples are sent to a gravity subroutine 150. The gravity filter sub-routine 150 determines the local gravity value and assigns it a numerical constant value referred to as the gravity offset. The gravity offset or local gravity value is passed onto a main sub-routine 160. The main sub-routine 160 manages all aspects of the elevator performance routine. The main sub-routine 160 removes the local gravity value from the acceleration sample to compensate for any slight deviations from the actual vertical acceleration. The main sub-routine 160 then passes the acceleration samples as they occur to a run filter sub-routine 170. The run filter sub-routine 170 removes all background noise from the acceleration samples. The acceleration samples are then returned to the main subroutine 160 where they are continuously monitored in order to recognize various measurement points as they occur in real time.

The vertical elevator movement is dissected into 11 critical categories in real time, as they occur, by the main sub-routine of the digital processor program embedded in the processor 80.

The elevator performance measurement data is divided into the following eleven categories:

1) Hi speed.
2) Leveling speed.
3) Hi speed duration.
4) Leveling speed duration.
5) Peak breakaway or start rate (start g).
6) Peak acceleration rate into hi speed (accel g).
7) Peak deceleration rate into either leveling speed for hydraulic elevator systems or stop for traction elevator systems (decel g).
8) Peak stop rate (stop g).
9) Peak vertical jerk.
10)Total run time.
11)Manual timer.

The filtered movement data is monitored for peak accelerations (peak breakaway, peak acceleration, peak deceleration and peak stop rate) as they occur. This data is reported as a "g" value, with one "g" representing the force of one gravity. Velocities, durations, run time and jerk values are calculated from the filtered movement data.

Figure 5:
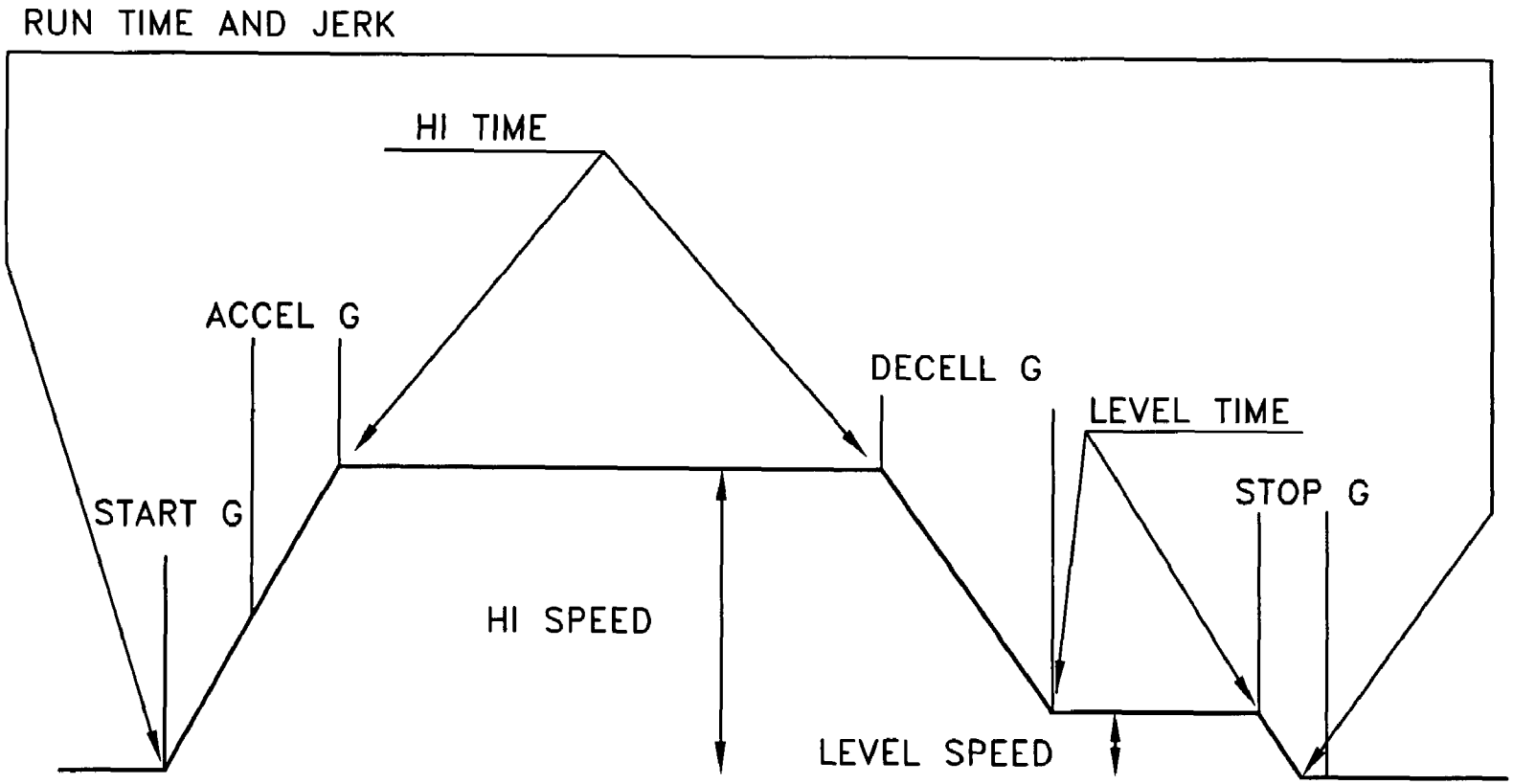
FIG. 5 is a time/amplitude graph depicting the performance profile of a typical elevator.

FIG. 5 is a typical example of a hydraulic elevator performance profile. The performance meter 10 reports the above-mentioned eleven measurement points derived from this profile. When each measurement point occurs the main sub-routine 160 will analyze the data to derive the properties for that measurement point. The four derived measurement units are time, rate, velocity and jerk. Time is monitored directly from the clock 100. Rate is determined from the following calculation (In the following calculations the units are listed in standard units, ft/s, ft/s/s and ft/s/s/s. The performance meter 10 may also be configured to measure and analyze the performance data using metric units, m/s, m/s/s and m/s/s/s.):

$$\text{Rate}(g)=((s-lg)\times SF)$$

where s=sample value in ft/s/s
lg=local gravity=offset gravity in ft/s/s units
g=gravity=32.18 ft/s/s
SF=ADC deflection at lg Velocity is then determined by multiplying the rate in ft/s/s by the monitored time to obtain a velocity value in ft/s. Jerk is a measurement of the smoothness of the elevator ride and is measured as the change in acceleration over time (ft/s/s/s). As each value is determined for each measurement point it is displayed on the readout screen 20.

Figure 7A:
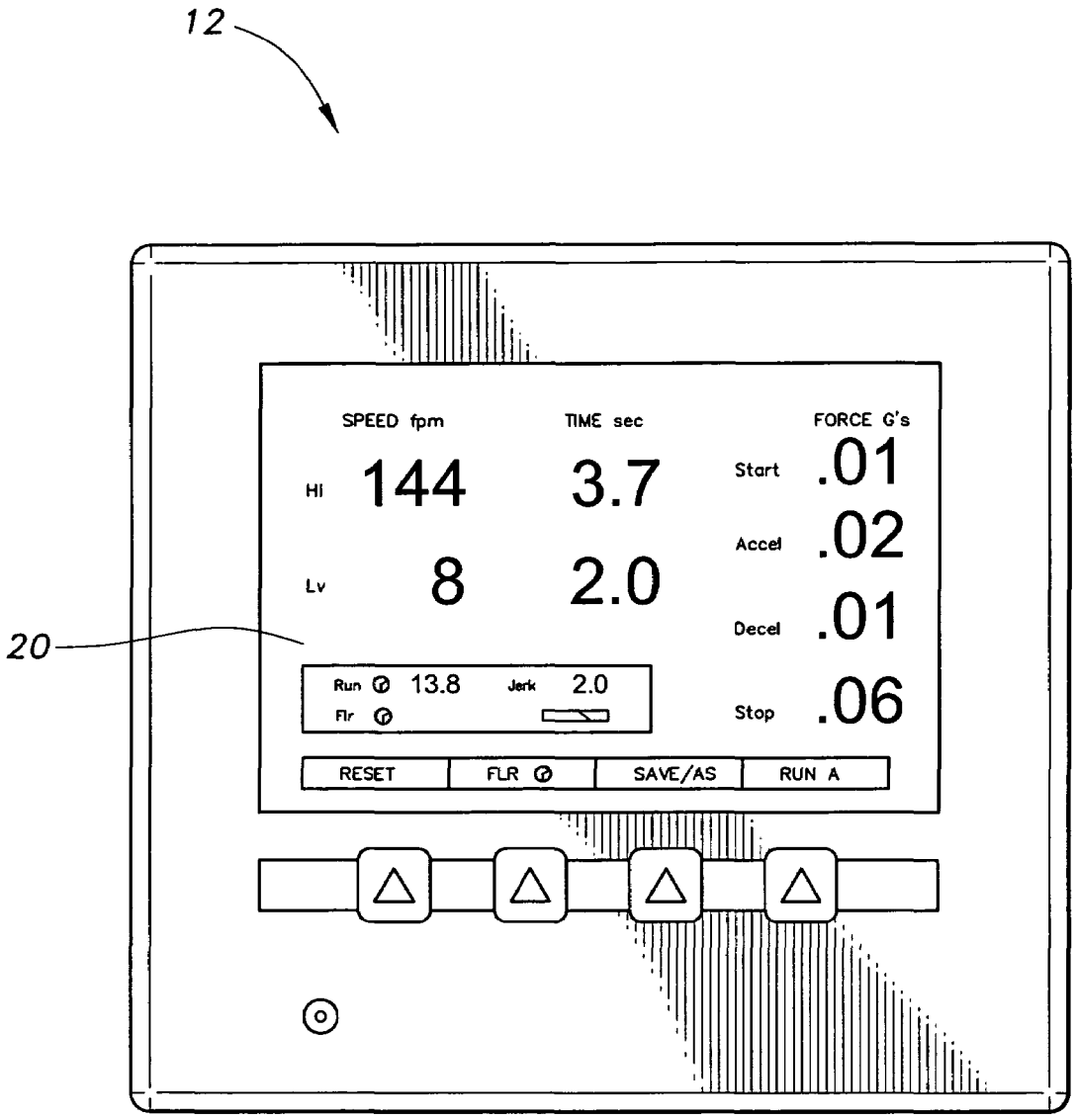
FIG. 7A is a top view of the elevator performance meter.
Figure 7B:
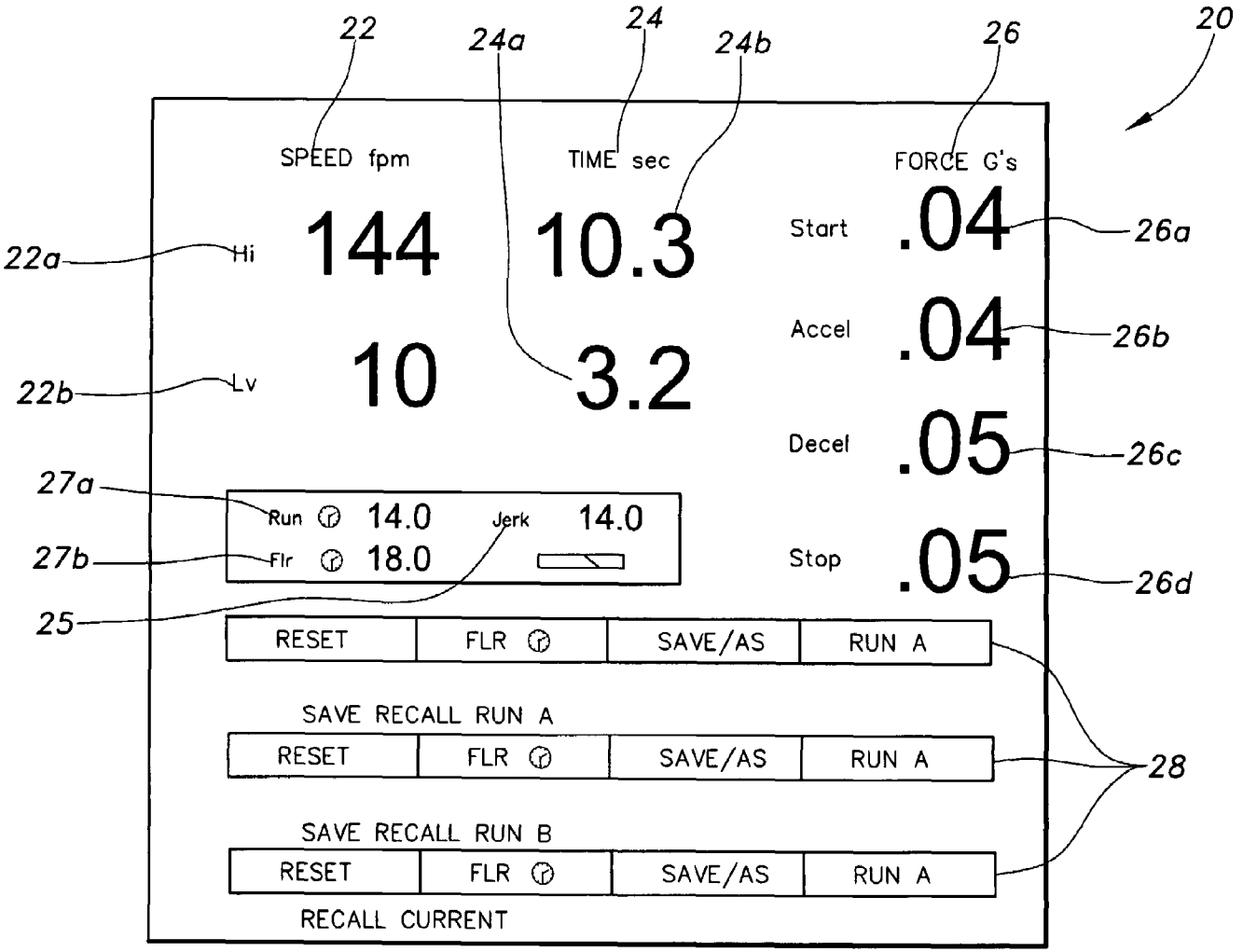
FIG. 7B is an enlarged view of the display screen of the elevator performance meter.

FIG. 7A is a top view of the performance meter 10 depicting the readout screen 20. It is to be understood that the measurements displayed on the readout screen 20 may also be configured and displayed in metric units as well. The readout screen 20 provides the results in an easily understandable, alphanumeric format. FIG. 7B is an enlarged view of the readout screen 20 showing the individual measurements that are displayed. The speed 22 is displayed in feet per minute showing both the hi speed 2*a* and the leveling speed 22*b*. The hi speed 22*a* is the average velocity while in hi time. The leveling speed 22*b* is the average velocity while in the leveling time. The time 24 is displayed next to the speed 22 in seconds and lists the hi time 24*a* and the leveling time 24*b*. The hi time 24*a* is the time elapsed while the elevator is in hi speed. The leveling time 24*b* is the time elapsed while in leveling speed. The run time 27*a*, which is the time elapsed between the start of the elevator movement and the end of the elevator movement, is displayed in seconds. The floor time 27*b*, which is the time elapsed during the movement of the elevator including the amount of time taken for opening and closing of the doors, is displayed in seconds as well. The jerk value 25 is displayed next to the run time 27*a* and the floor time 27*b*. The jerk value 25 is the peak jerk measured during the run time 27*a*. Finally, the start 26*a*, accel 26*b*, decel 26*c* and stop 26*d* forces are list in units of g. Each force represents the peak g value achieved during the particular intervals along the profile in FIG. 5. As the various measurement points occur the main sub-routine will send that data to the display 20.

The first data point that is measured is the breakaway acceleration rate value. The breakaway acceleration is labeled as start g on the profile in FIG. 5. Breakaway is the peak g measured during the first 0.75 seconds of movement. During breakaway the peak acceleration rate measured will be displayed in the start g category 26*a* on the display 20. Also, the high speed category 22*a* will start to increase and the run clock 27*a* will begin to increment. At this point the change in acceleration rate, or jerk value, is monitored. The peak jerk value measured anywhere during the entire elevator performance test is retained in the jerk category 25.

After the breakaway period all acceleration rates are measured until the elevator reaches hi speed and are placed into the accel g category 26*b*. As the elevator reaches the first stabilized velocity, as shown on the profile in FIG. 5 as hi time, a hi speed timer starts. This timer will continue running until the elevator starts to decelerate. Once the elevator begins to decelerate the hi speed category 22*a* and the hi time 24*a* category are displayed.

As the elevator starts to slow down the deceleration rate is monitored. The peak deceleration rate measured during this period is displayed in the decel g category 26*c*. At this point in the test sequence a determination is made about the type of elevator that is being tested. If the elevator is found to be a traction type elevator the test sequence moves directly to the stop g test at this time. If the elevator is found to be of a hydraulic type, leveling speed and leveling time measurements are performed. As the elevator enters into a stabilized velocity the leveling timer starts incrementing and the velocity is monitored to determine the average leveling speed during the leveling period. The leveling speed and the leveling time are then displayed in the leveling speed category 22*b* and the leveling time category 24*b*. As the elevator decelerates to a stop, the deceleration rate is monitored. The peak rate measured during this period is displayed in the stop g category 26*d* on the display screen 20.

At the conclusion of the elevator stop the run time clock 27*a* the floor time clock 27*b* is stopped. (The floor time clock 27*b* is under operator control). The performance data is now locked and is displayed. This concludes the automatic test sequencing. All data is now fully displayed as shown in FIG. 7B. All of the performance data on the display screen 20 will remain in their respective categories until the performance meter 10 is reset for another test.

At the end of the measurement sequence the processor program will allow the operator to view or store the performance data to the internal run time memory in the data storage unit 180. As shown in FIG. 7B, the display screen 20 will display a number of options for saving the performance data. This is shown as the test data save/rcl function 28. Up to two separate test results may be saved to the processor's 80 internal run time memory 180. Data may also be saved in the external memory 90.

During the test sequence various measurement points are compared to internal alert levels. At the appropriate time alert messages flash on the display unit 20 for any test point that is found to be outside of the recommended range. Alert messages include, but are not limited to, Hi, Lo, Fast, or Slow.

The processor program also controls a number of housekeeping sub-routines. The housekeeping sub-routines are general programs that are used to customize and organize the readout data on the display 20. These housekeeping sub-routines are used commonly and would be obvious to anyone skilled in the art.

It is to be understood that the present invention is not limited to the embodiments described above, but encompasses any and all embodiments within the scope of the following claims.

We claim:

1. An elevator performance meter, comprising:

an internal processor for controlling the functions of said elevator performance meter;

a sensor for continuously monitoring and measuring the acceleration of an elevator and generating an analog voltage output signal;

an anti-alias filter, positioned in direct communication with said sensor, for receiving the analog signal from said sensor and removing background noise from the signal;

an analog to digital converter for receiving low-pass filtered data from said anti-alias filter and converting the filtered data into a digital numerical value and send the digital numerical value to said processor;

a clock for providing an accurate time base for said internal processor;

a power supply for providing power to said elevator performance meter;

a battery pack for providing battery power to said power supply;

a battery monitor for monitoring the level of power remaining in the battery pack and reporting a warning to said processor when the level of power remaining in said battery pack is lower than a predetermined limit;

an outer housing having a top surface, a bottom surface and a plurality of side portions for encasing said sensor, said anti-alias filter, said analog to digital converter, said clock, said power supply, said battery pack and said battery monitor in a single self contained enclosure;

a processor program embedded in said processor for analyzing the filtered data sent to said processor and for managing the functions of said elevator performance meter; and a display unit for receiving the results of the analyzed data from said processor and displaying the results to the operator of the elevator performance meter in an alphanumeric format;

whereby said elevator performance meter measures the variations in the velocities, accelerations, jerk and run durations of the elevator, analyzes the measurements and provides the results of the analysis to the operator of the performance meter in an easily understandable format.

2. The elevator performance meter according to claim 1, a data entry unit disposed along the top surface of said housing for entering operator menu selections into said processor.

3. The elevator performance meter according to claim 2, wherein said data entry unit is a keypad having a plurality of entry keys.

4. The elevator performance meter according to claim 1, wherein said display unit is an LCD readout screen.

5. The elevator performance meter according to claim 1, further comprising a padded carrying case adapted for receiving said housing, said case aiding in the level placement of said elevator performance meter on the floor of the elevator by reducing uneven surface on the elevator floor that have an adverse affect of the accuracy of said elevator performance meter.

6. The elevator performance meter according to claim 1, further comprising a wire remote keypad device for allowing the operator to enter menu selections into said processor while standing up during the monitoring of the elevator, said keypad device comprising an elongate cord secured to said housing having a connecting end and a distal end, an input pad disposed on the distal end of said cord and a plurality of input keys disposed on said input pad.

7. The elevator performance meter according to claim 1, wherein said battery pack comprises four AA alkaline batteries.

8. The elevator performance meter according to claim 1, wherein said power supply comprises a plurality of electronic switches and inductors for creating precisely controlled power output voltages from the power supplied by said battery pack.

9. The elevator performance meter according to claim 1, wherein said sensor is an accelerometer.

10. The elevator performance meter according to claim 1, further comprising a processor external memory unit for supplying program data to said processor.

11. The elevator performance meter according to claim 1, further comprising a mother board for accommodating said sensor, said processor, said anti-alias filter, said analog to digital converter, said clock, said batter monitor, said power supply, and said battery pack and a separate daughter board for accommodating said display unit.

12. The elevator performance meter according to claim 1, wherein said processor program comprises:

a gravity filter sub-routine for determining a local gravity value and assigning that value a numerical constant;

a main sub-routine that manages all aspects of the elevator performance meter and receives the analyzed, filtered acceleration data and the local gravity value from said gravity filter and removes the local gravity value from said filter acceleration data;

a run filter sub-routine for receiving acceleration samples from said main sub-routine and removing background noise from the samples and delivering the samples back to said main sub-routine for further analysis; and an internal run time memory unit for receiving analyzed data from said main sub-routine and storing the data.

13. A process for measuring the performance of an elevator comprising the steps of:

placing an elevator performance meter on the floor of an elevator to be tested and turning on the power of the meter;

the operator placing an elevator floor call to begin movement of the elevator;

continuously monitoring the raw acceleration of the elevator by an accelerometer enclosed in said meter and transferring measured raw acceleration data to an anti-alias filter;

removing background noise from the raw acceleration data caused by acceleration voltage aliases with an anti-alias filter and transferring a filtered data signal to an analog to digital converter;

converting the filtered data into a digital numerical signal and sending the digital signal to a processor;

analyzing and measuring the digital signal with a processor program and sending the results of the analysis and measurements to a display unit; and displaying the results of the analysis and measurement on a display unit in an alphanumeric format.

14. The process according to claim 13, further comprising automatically calibrating the elevator performance meter prior to the operator entering in the elevator floor call.

15. The process according to claim 13, wherein said analyzing and measuring step comprises:

using a gravity filter to determine a local gravity value by analyzing a plurality of acceleration samples and assigning the local gravity value a numerical constant and transferring the local gravity value and the filter data signal to a main sub-routine in the processor program;

mathematically removing the local gravity value from said filtered data signal with the main sub-routine and transferring acceleration samples to a run filter sub-routine;

removing all background noise from the acceleration samples with the run filter sub-routine and returning the acceleration samples to the main sub-routine; and continuously monitoring the acceleration samples with said main sub-routine to recognize various measurement points as they occur in real time.

16. The process according to claim 15, further comprising the step of dissecting the acceleration samples into eleven critical categories in real time as they occur and measuring the properties of each point by the main sub-routine.

17. The process according to claim 16, further comprising the step of displaying the measurements for each critical category separately on said display unit as they occur in real time.

18. The process according to claim 13, further comprising saving the results from the display unit in an internal run time memory.

* * * * *